US006021881A

United States Patent [19]

Wild

[11] Patent Number: 6,021,881

[45] Date of Patent: Feb. 8, 2000

[54] ANTI-FRAUD STRING CUTTER

[75] Inventor: Ronald Lee Wild, Hamilton County, Ind.

[73] Assignee: Lucent Technologies Inc., Murray Hill, N.J.

[21] Appl. No.: 08/986,293

[22] Filed: Dec. 6, 1997

Related U.S. Application Data

[63] Continuation-in-part of application No. 08/898,329, Jul. 22, 1997, abandoned.

[51] Int. Cl.[7] ..... G07F 1/04

[52] U.S. Cl. ..... 194/203; 379/145

[58] Field of Search ..... 194/203, 349; 379/145

[56] References Cited

U.S. PATENT DOCUMENTS 5,018,193 5/1991 DeArkland ..... 379/145

5,088,587 2/1992 Goodrich et al. ..... 194/345

5,325,952 7/1994 McGinley et al. ..... 194/203

FOREIGN PATENT DOCUMENTS 2201538 9/1988 United Kingdom ..... 194/203

*Primary Examiner*—F. J. Bartuska

[57] ABSTRACT

An anti-fraud string cutter for a coin telephone instrument having a serpentine coin path. The string cutter is fabricated as a stack of notched, slit, sheet metal plates having alternately off-set flat and wavy teeth which are adapted to snag and cut, between adjacent ones of the plates, any string threaded through said coin path by a fraudulent user. String cutters are advantageously to be mounted adjacent to one of the cusps of the serpentine path and above the coin return hopper.

7 Claims, 2 Drawing Sheets

ANTI-FRAUD STRING CUTTER

This is a continuation-in-part application of application Ser. No. 08/898,329 filed Jul. 22, 1997, which is hereby abandoned.

FIELD OF THE INVENTION

This invention relates to coin fraud countermeasures and, more particularly, to the capture and destruction of instruments used to perpetrate coin fraud.

BACKGROUND OF THE INVENTION

A species of coin fraud has arisen in which the miscreant drills a hole through a coin of the type accepted by a coin-operated device, such as a coin telephone instrument, and attaches to the cone a flexible cord or string, such as monofilament fishing line or dental floss, threading the string through the drilled hole and knotting the end to tether the coin. The coin is then deposited in the coin slot and allowed it to fall through the coin chute while the miscreant operates the coin return lever to cause the coin to enter the reject chute leading to the coin return hopper. When the coin enters the coin return hopper it is replaced by a wad of material and then the string is pulled back into the telephone instrument to jam the coin return chute so that subsequent customers who are legitimately entitled to receive a refund of their deposited coins will be cheated. Thereafter the miscreant returns, removes the wad of blocking material and steals the coins that have accumulated in the coin return chute. It would be extremely advantageous to be able to frustrate such fraudulent usage.

Heretofore it has been suggested to insert a string cutter in the coin path to sever the coin from the tether. Unfortunately, certain types of string, notably dental floss, are difficult to be grabbed and cut by a conventional string cutter. It would be of great advantage to overcome this difficulty.

SUMMARY OF THE INVENTION

In accordance with the principles of the illustrative embodiment, a string cutter comprises an assembly of at least two sheet metal plates having tapered, alternately bent, dentiform ends that are adapted to engage between them any string that has fraudulently been threaded through the coin path of a coin telephone instrument. One such assembly is advantageously mounted at one of the cusps in the upper part of the instrument's coin path. Another is advantageously mounted lower down and closer to the coin return hopper. The tapered dentiform ends guide the string to one of the apices between the tapered teeth of the plates, causing the string to be snagged between the plates and severed by the sharp edges of the teeth.

DESCRIPTION OF THE DRAWING

The foregoing and other features of the illustrative embodiment may become more apparent from a reading of the ensuing description, in which.

GENERAL DESCRIPTION

Figure 1:
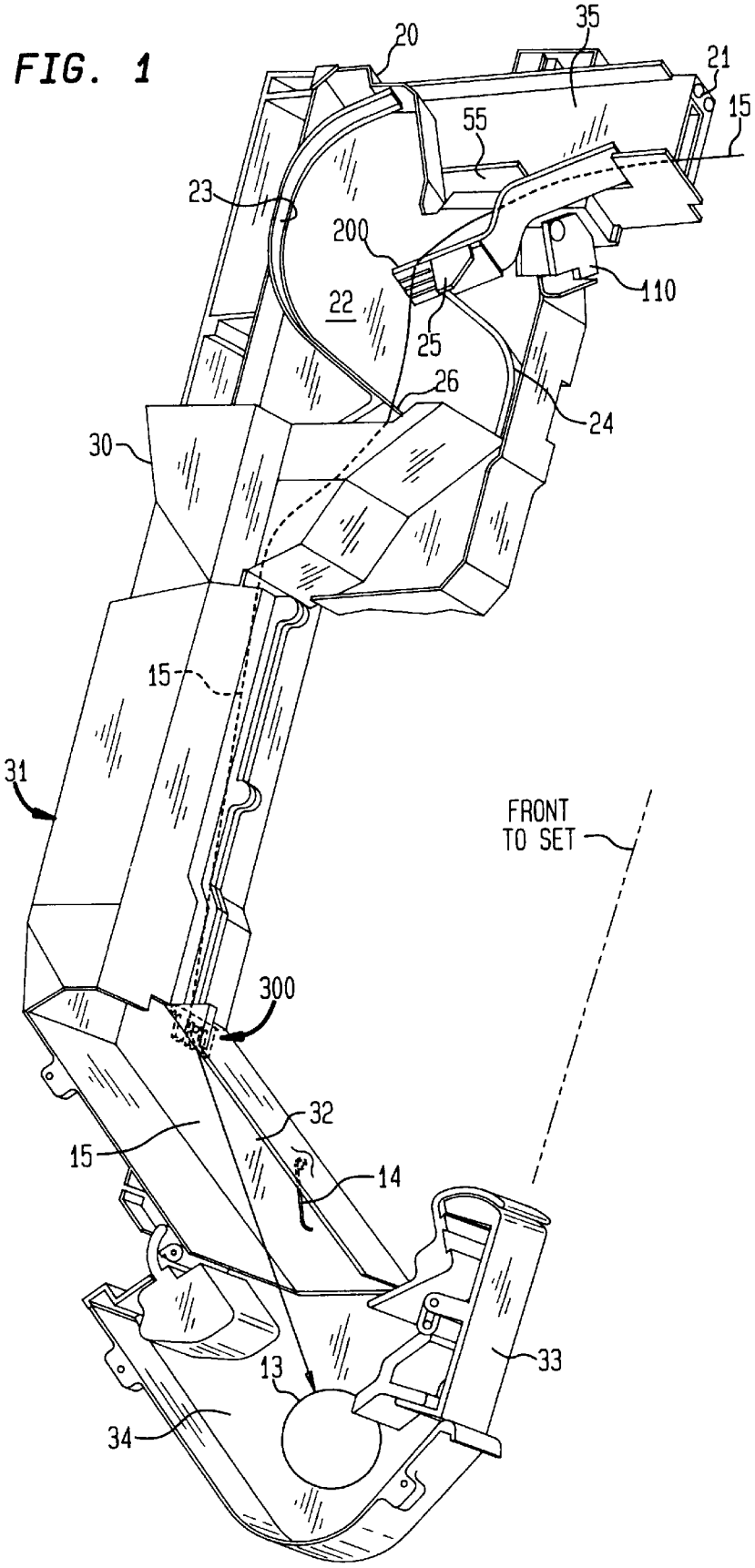
FIG. 1 shows the serpentine coin path of a prior art coin telephone in which the string cutters of the illustrative embodiment have been installed.

FIG. 1 shows an isometric view of a coin chute apparatus 10 of a coin telephone set of the type illustrated in U.S. Pat. No. 5,088,587 having a coin slot 21 into which a coin 13 may be deposited. When deposited in coin slot 21, the coin falls by gravity down a serpentine coin chute path 22 defined by walls 23 and 24 in the main body 20. Articulated cusps 25 and 26 project from walls 23 and 24 respectively. Cusps 25 and 26 cause the coin to drop one or more times in its travel down path 22. As described in the aforementioned patent, lever 110 can be operated to release a coin 13 that may have become stuck in the coin chute 22 by opening the door (not shown) covering chute 22 slightly to release the coin into funnel 30 leading to reject chute 31, from which the coin enters the coin return hopper (not shown). Alternatively, lever 110 may be operated just after the coin has been deposited into slot 21 to activate the clean-out apparatus 35 described in the aforementioned patent so as to cause the coin to enter funnel 30 and then reject chute 31.

In either event, the fraudulent user deposits a coin 13 tethered to a string 15 into the coin slot 21 and repeatedly operates lever 110 to cause the coin to drop into funnel 30 and then fall into reject chute 31 which connects with the coin return hopper 34. The miscreant then opens door 33 of the coin return hopper 34 to access the tethered coin. At this point the fraudulent user may attach a wad of material to the coin 13 and pull the string 15 back at coin slot 21 so as to cause the wad to block the reject chute 31, or its extension 32, which connects with coin return hopper 34. While blocking of the coin return chute 11 is, to some extent, inhibited by flapper 14, unfortunately, it is not fool-proof so that the blocked reject chute 32 or reject chute extension 32 will then accumulate subsequently deposited coins that should be returned to a legitimate user.

In accordance with the invention, this fraudulent procedure is frustrated by installing a pair of string cutters 200, 300. One string cutter 200 is installed at the upper portion of the serpentine coin path 22 adjacent to the clean out port 55 of clean out mechanism 35, and another string cutter 300 being installed in the lower portion of the coin reject chute 31, just above the coin return hopper.

Figure 2:
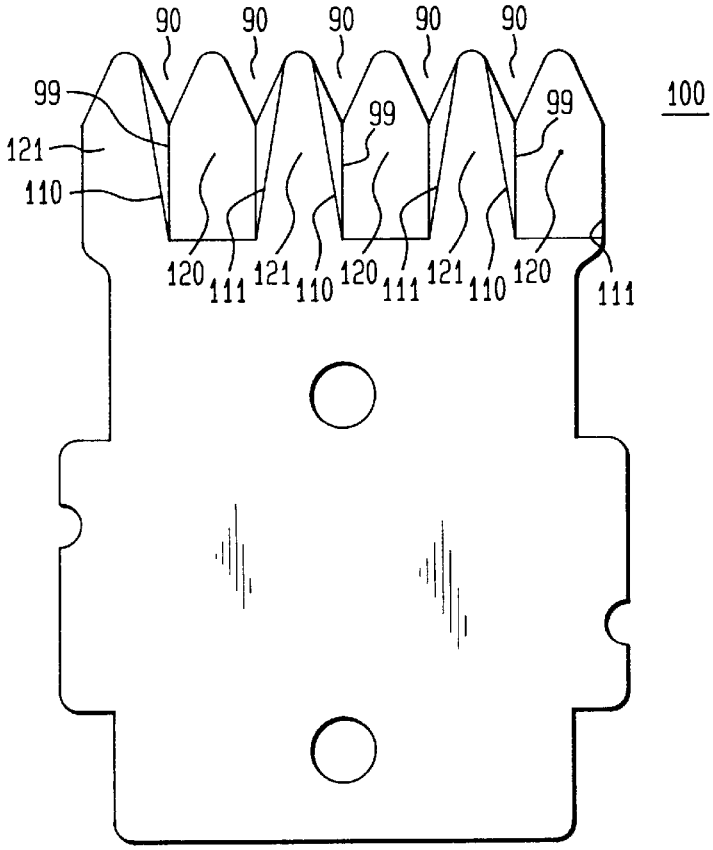
FIG. 2 is plan view of one of the sheet metal plates of the cutter.
Figure 3:
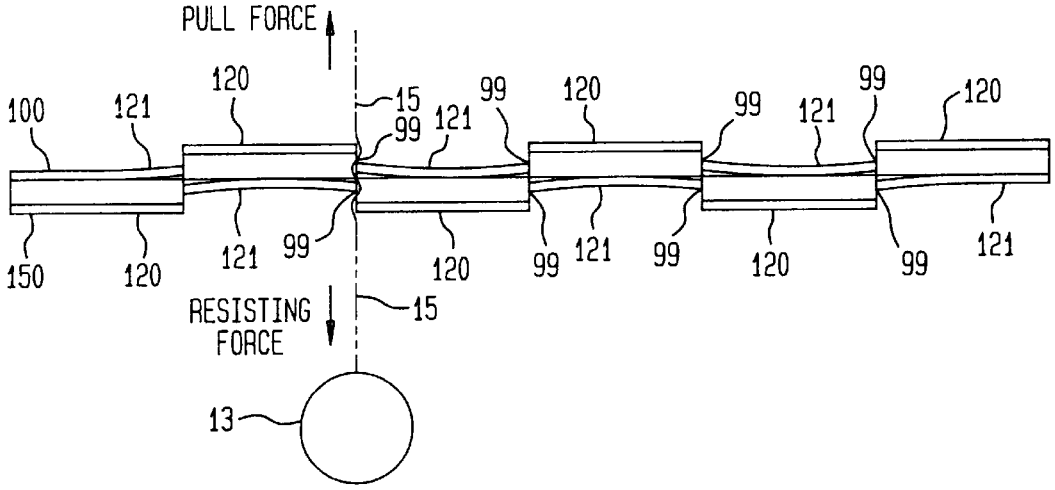
FIG. 3 is an end view of a stack of the sheet metal plates forming the illustrative cutter showing a string that has been snagged.

A plan view of one of the sheet metal plates 100 of a string cutter 200 is shown in FIG. 2. Spaced-apart V-shaped notches 90 are cut in one end of plate 100. Plate contains straight slits 99 at the apex of each notch and slanting creases 110, 111 at one side or the other of straight slits 99 so as to form a wavy row of off-set flat teeth 120 and creased or warped teeth 121. An end view of a stack of two such sheet metal plates is shown in FIG. 3. There, the plate 100 of FIG. 2 is laid atop a similar plate 150 but whose off-set flat and warped teeth are in opposing sequence. The apex of notches 90 of plates 100 and 150 are aligned. However, the off-set creased teeth 121 of plate 100 are aligned with the off-set flat teeth 120 of plate 150. When the coin 13 deposited by a fraudulent user trails its string 15 down the coin chute 22 or reject chute 31, one of tapered teeth 120, 121 will engage the string and guide it towards the apex of one of notches 90. There, string 15 will have the weight of coin 13 pulling downward. When, however, the fraudulent user attempts to pull upward on string 15, the string will become follow a serpentine path between the abutting notches of sheet metal plates 100, 150 becoming wedge at their respective abutting slits 99, causing the sharp edges of the metal plates to sever the string. Thus, the serpentine shape assumed by string 15 between plates 100, 150 allows for the pull force exerted on the string by the fraudulent user to exceed the weight of the coin plus string without allowing the string to slip.

What has been described is deemed to be illustrative of the principles of the invention. Further and other modifications will be apparent to those skilled in the art without however departing from the spirit and scope of the invention.

What is claimed is:

1. An anti-fraud device positioned in the serpentine coin path of a coin telephone instrument comprising, in combination:

a stack of notched, slit, sheet metal plates forming a line of alternately off-set flat and wavy teeth, the notches of said stack having their apices aligned, the wavy teeth of one plate being aligned with the flat tooth of an adjacent plate.

2. An anti-fraud device according to claim 1 wherein said teeth are tapered.

3. An anti-fraud device according to claim 1 wherein one said stack of plates is mounted adjacent to one of the cusps of said serpentine coin path.

4. An anti-fraud device according to claim 1 wherein one said stack of plates is mounted adjacent to the coin return hopper of said path.

5. An anti-fraud device according to claim 2 wherein said tapered teeth are adapted to guide a string introduced into said coin path to one of said aligned apices to slit said string.

6. An anti-fraud device according to claim 5 wherein the plates of said stack are adapted to tension said string between them at said apices when said string is pulled in a direction opposite to the direction in which said coin falls through said coin path.

7. An anti-fraud device according to claim 6 wherein said tapered teeth are adapted to cause said string to assume a serpentine shape between said plates, said string becoming wedged in the slits of said plates.

* * * * *